US005957680A

United States Patent [19]

Doucet et al.

[11] Patent Number: 5,957,680

[45] Date of Patent: Sep. 28, 1999

[54] LIGHTER HAVING A GUARD MEMBER AND COOPERATING BLOCKING MEMBERS

[75] Inventors: Michel J. M. Doucet, Bain sur Ouste; Rene D. Frigiere, Allaire, both of France

[73] Assignee: BIC Corporation, Milford, Conn.

[21] Appl. No.: 09/061,911

[22] Filed: Apr. 17, 1998

[51] Int. Cl.[6] ..... F23D 11/36

[52] U.S. Cl. ..... 431/153; 431/277

[58] Field of Search ..... 431/153, 277, 431/276

[56] References Cited

U.S. PATENT DOCUMENTS

| | | | |
|---|---|---|---|
| 5,085,578 | 2/1992 | Hunter | 431/277 |
| 5,197,870 | 3/1993 | Yang | 431/153 |
| 5,271,731 | 12/1993 | Hsin-Chung | 431/153 |
| 5,431,558 | 7/1995 | McDonough et al. | 431/153 |
| 5,456,598 | 10/1995 | McDonough et al. | 431/153 |
| 5,483,978 | 1/1996 | Doiron | 431/153 |
| 5,520,197 | 5/1996 | McDonough et al. | 431/153 |
| 5,735,294 | 4/1998 | McDonough et al. | 431/153 |

FOREIGN PATENT DOCUMENTS

| | | |
|---|---|---|
| 0 672 867 A1 | 9/1995 | European Pat. Off. . |
| WO 95/04247 | 2/1995 | WIPO . |

*Primary Examiner*—Carroll B. Dority
*Attorney, Agent, or Firm*—Pennie & Edmonds LLP

[57] ABSTRACT

The lighter of the present invention provides a resiliently deformable guard that covers a portion of the striking wheel assembly. To operate the lighter, a user exerts sufficient pressure to depress the guard before rotating the striking wheel assembly. Additionally, the lighter of the present invention provides blocking members to engage the deformable guard when the user depresses the valve actuator before exerting pressure to depress the guard.

9 Claims, 8 Drawing Sheets

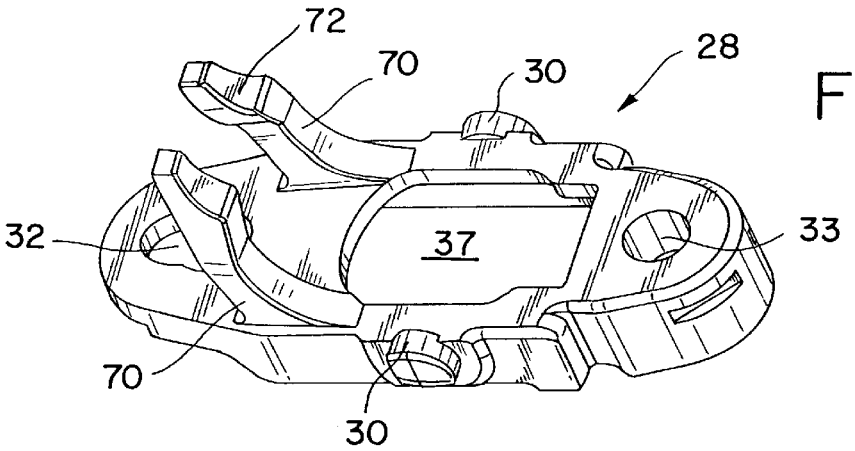
FIG. 5
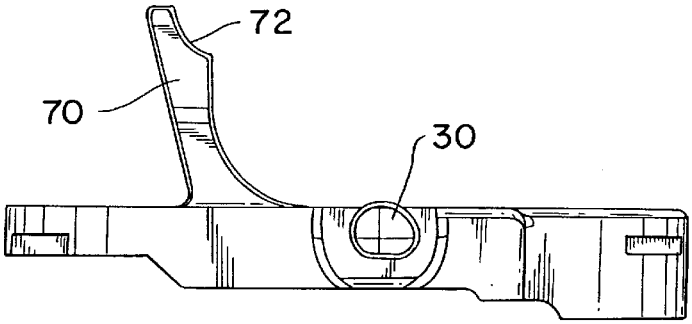
FIG. 6
FIG. 7
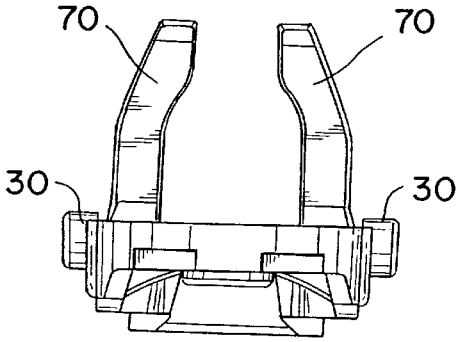
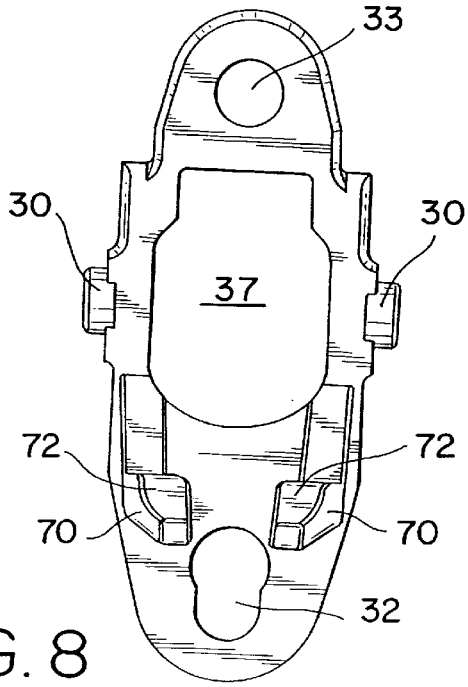
FIG. 8

LIGHTER HAVING A GUARD MEMBER AND COOPERATING BLOCKING MEMBERS

FIELD OF THE INVENTION

The invention relates to a lighter having a guard member and blocking members disposed on a valve actuator incorporated into the lighter. Such devices help to resist undesired usage of the lighter by young children.

BACKGROUND OF THE INVENTION

Recently, attention has been directed toward increasing the difficulty of actuating lighters by persons normally not able to appreciate the potential danger of the flame. Individuals normally contemplated in these efforts are young children in the age category of five years or younger.

A conventional lighter includes a body containing a fuel reservoir filled with a liquefied and pressurized hydrocarbon fuel, a valve actuator lever, a striker wheel, a flint in frictional contact with the striker wheel, and a fuel flow control valve in fluid communication with the fuel reservoir. After the striker wheel is rotated against the flint by digital manipulation to produce sparks, the valve actuator lever is depressed allowing gaseous hydrocarbon fuel to flow out of the reservoir through the flow control valve. The sparks then ignite the released fuel producing a flame. Such lighters are known in the art, and are commercially available.

It is relatively easy for the intended adult users to operate the conventional prior art lighters. It is desirable to increase the difficulty of use to limit the ability of young children under five years of age to operate such lighters. For this reason there are many proposed "child-resistant" lighters offered in the patent literature and on the market. Examples of such patents include U. S. Pat. No. 5,125,829; U.S. Pat. No. 5,002,482; U.S. Pat. No. 5,165,886; U.S. Pat. No. 5,090,893; and PCT Application No. WO 93/17282. Each of the disclosed devices has in common the fact that the child-resistant feature somehow acts to block movement of the gas fuel release mechanism to prevent operation of the lighter.

Other "child resistant" lighters incorporate a resiliently deformable guard member disposed radially above the striking wheel assembly. To operate the lighter, a user may assert sufficient pressure to depress the deformable guard before attempting to rotate the striking wheel assembly to produce sparks necessary to ignite the fuel that would be released after successful depression of the valve actuator. Examples of such lighters include U.S. Pat. Nos. 5,483,978 and 5,520,197 and WO 95/04247. Each of these disclosed devices has in common the fact that the child resistant feature increases the difficulty of rotating the striking wheel assembly. The disclosures of the '978 and '197 patents and WO 95/04247 are hereby incorporated by reference.

SUMMARY OF THE INVENTION

Accordingly, it is an object of the invention to provide a lighter which is relatively easy to operate by an adult, but resistant to operation by young children.

It is another object of the invention to provide a child-resistant feature for such a lighter that resists the production of sparks.

These and other objects are achieved according to the present invention by a lighter that requires at least a threshold amount of digital pressure, i.e., pressure exerted by a finger or thumb, be applied on a protective guard before the striking wheel assembly can be rotated against the flint to create sparks. Additionally, if the valve actuator is depressed before digital pressure is exerted on the guard, then portions of the valve actuator engage the guard to inhibit movement of the guard.

These features are provided by a lighter comprising a lighter body containing a fuel reservoir in communication with a valve for releasing fuel therefrom, and a spark producing element rotatable by a user to produce sparks directed toward the valve. The spark producing element is mounted on the body with at least a portion exposed of manipulation and rotation by the user. The lighter further comprises a guard member mounted on the lighter and extending around at least the exposed portion of the spark producing element. The guard member is disposed radially outward from the spark producing element and is depressible to a position which permits the manipulation of the spark producing element. The lighter also comprises a valve actuator depressible to actuate the fuel valve to release fuel, and at least one blocking member cooperating with the valve actuator to engage the guard member to resist the depression of the guard member after the valve actuator is depressed.

The valve actuator of this lighter may also be pivotally and movably supported on the lighter body, such that the valve actuator can be displaced during the assembly process to facilitate the manufacture of the lighter.

BRIEF DESCRIPTION OF THE DRAWINGS

FIG. 5 is a perspective view of a valve actuator in accordance to the present invention;

FIG. 6 is a front plan view of the valve actuator shown in FIG. 5;

FIG. 7 is an end view of the valve actuator shown in FIG. 5;

FIG. 8 is a top plan view of the valve actuator shown in FIG. 5;

DETAILED DESCRIPTION OF THE PREFERRED EMBODIMENTS

Figure 1:
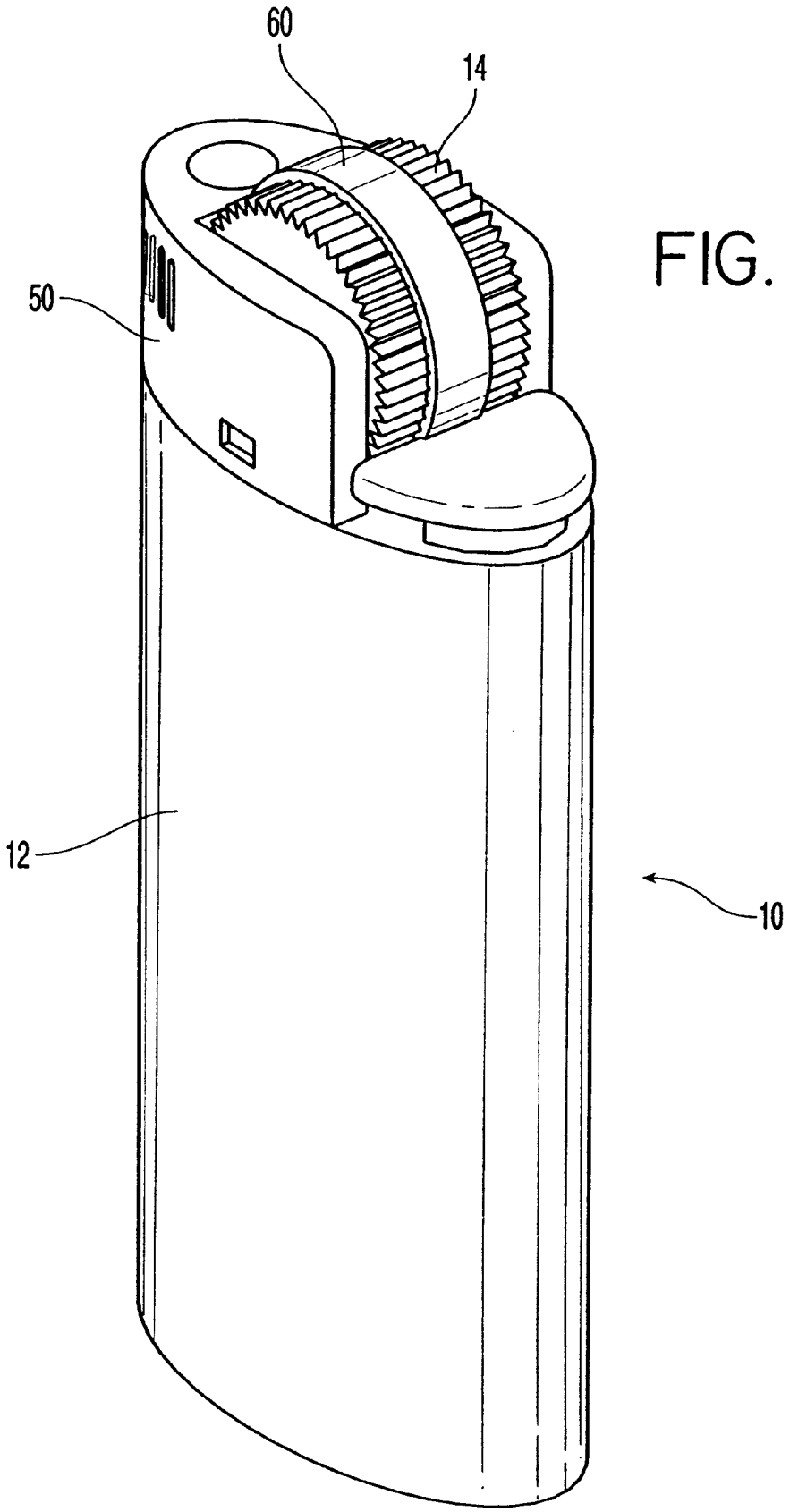
FIG. 1 is a perspective view of a lighter of the present invention.

Referring to the drawings, wherein like reference numbers are used to designate like parts and as shown in FIG. 1, lighter 10 according to the present invention is shown having a protective guard 60 disposed above a portion of the striking wheel assembly.

Figure 2:
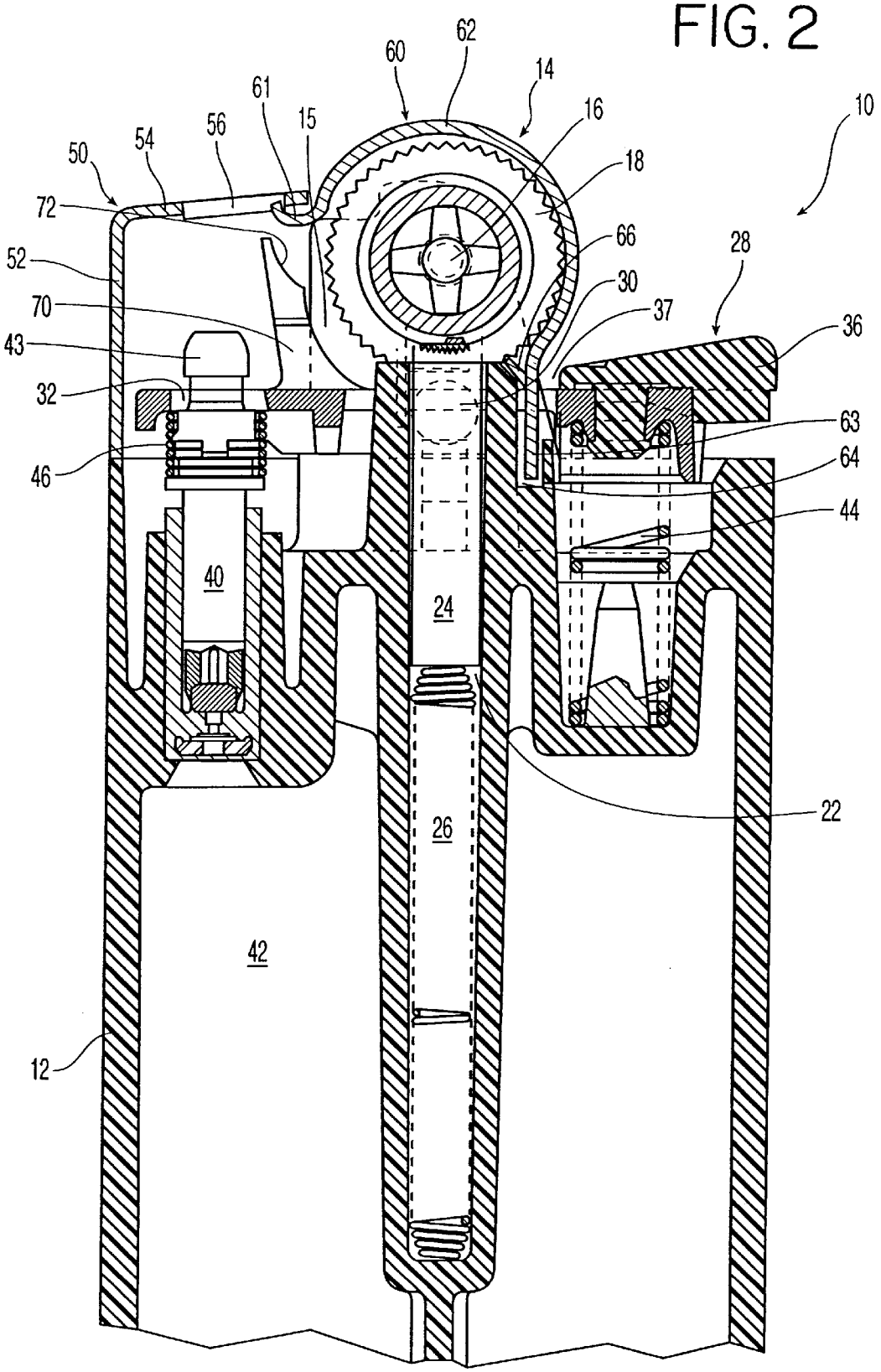
FIG. 2 is cross-sectional side view of the lighter in accordance to the first embodiment of the present invention.
Figure 3:
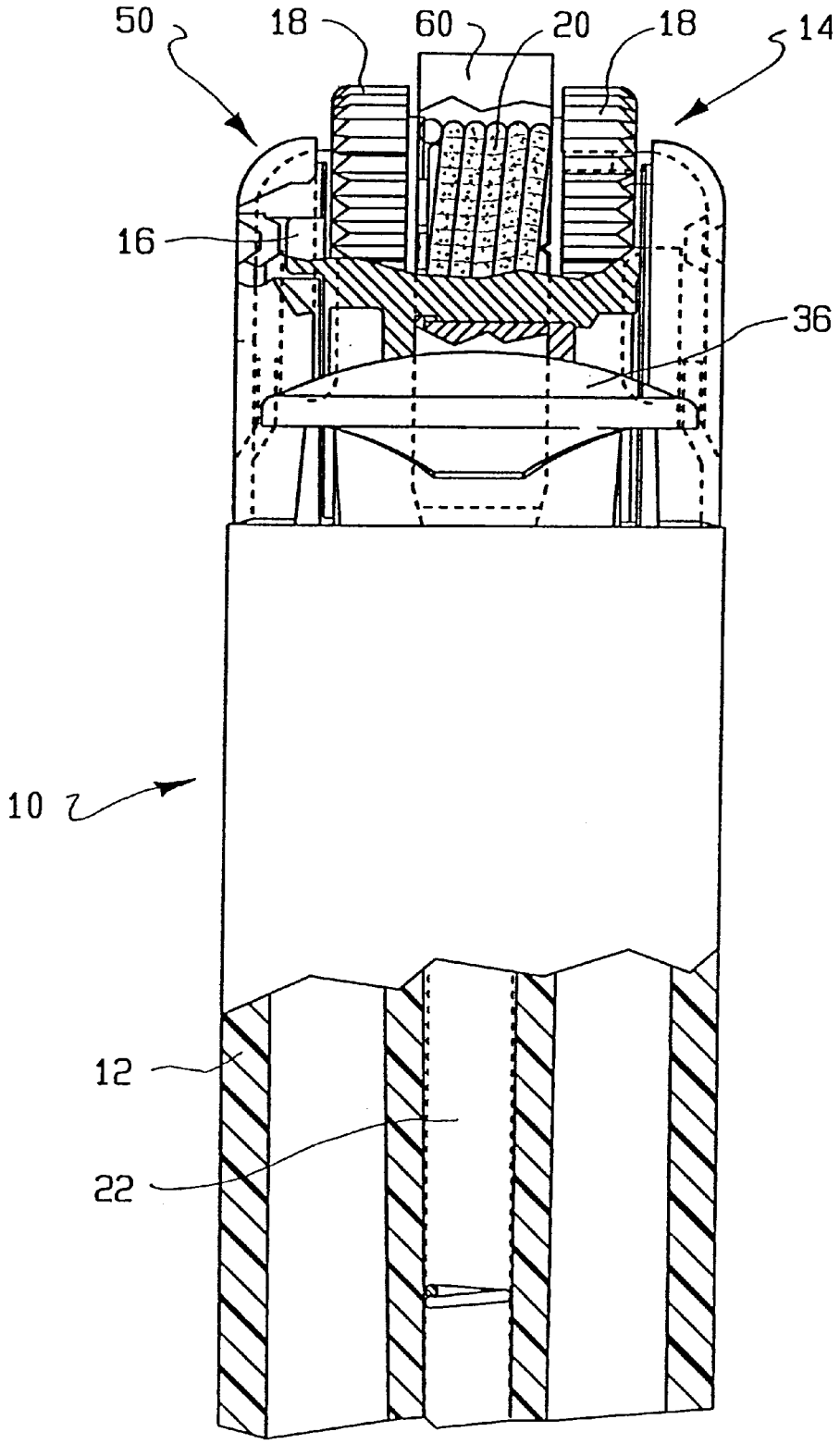
FIG. 3 is a partial cross-sectional rear view of the lighter shown in FIG. 2.
Figure 4:
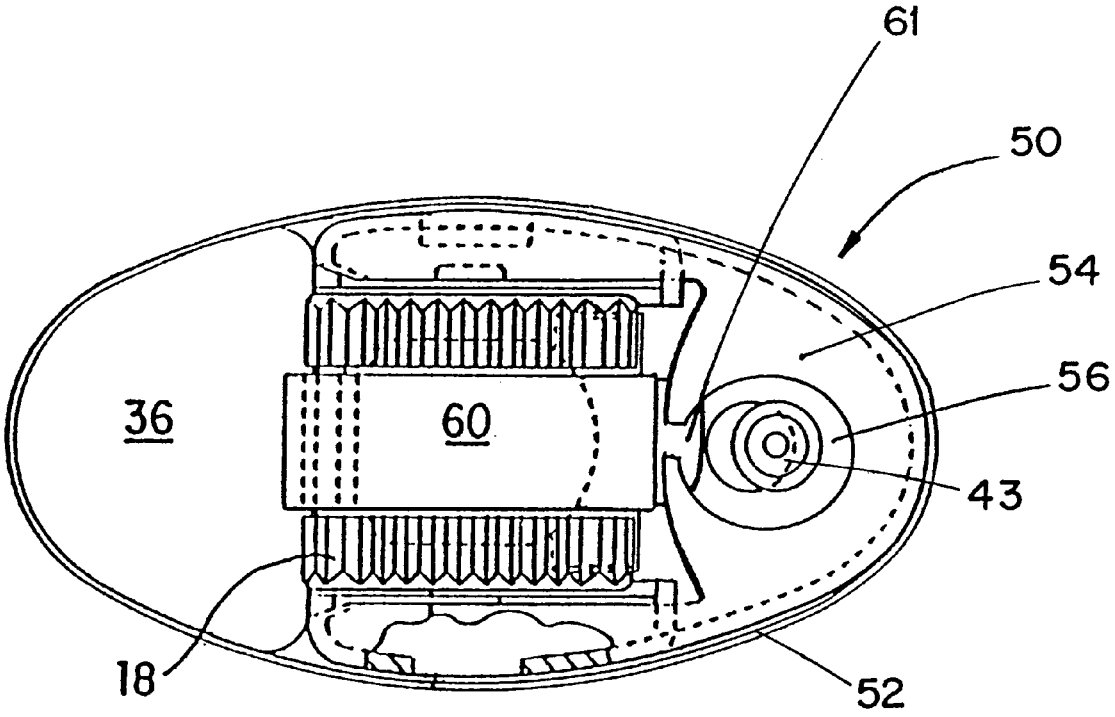
FIG. 4 is a top view of the lighter shown in FIG. 2.
Figure 9:
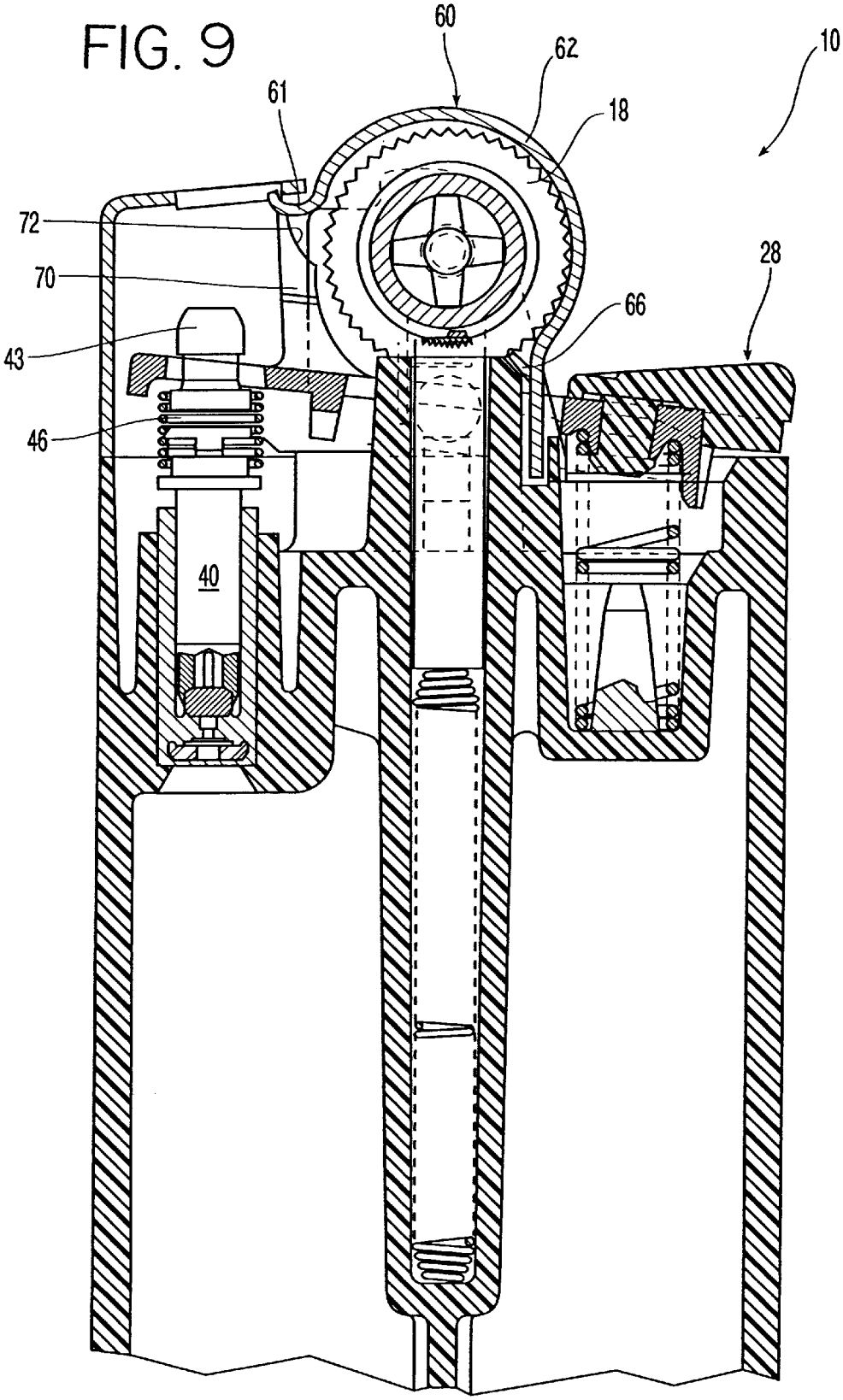
FIG. 9 is a cross-sectional side view of the lighter shown in FIG. 2 with the valve actuator depressed before the guard member is depressed.

As shown in FIGS. 2, 3 and 4, lighter 10 has body 12 with striking wheel assembly 14 rotatably disposed between spark-wheel supports 15 (shown partially in phantom in FIG. 2) via axle 16. Striking wheel assembly 14 is located at the top end of body 12 and comprises turning wheels 18 disposed on each side of rotary sparker 20. The two turning wheels 18 and sparker 20 are connected to one another, and are mounted coaxially on axle 16. Axle 16 is supported on apertures 76 defined on spark-wheel supports 15. Body 12 defines a cylindrical cavity 22 positioned longitudinally and centrally within body 12. Flint 24 is disposed within cavity 22, and is urged into frictional contact with rotary sparker 20 by spring 26.

In this embodiment, lighter 10 further comprises a depressible valve actuator 28, which is pivotally mounted on body 12 through tabs 30, which are located below axle 16, as shown in FIGS. 2. Referring to FIGS. 5–8, valve actuator 28 defines slot 32 at one end. At the other end of the valve actuator 28 is aperture 33. Thumb pad 36 (shown in FIGS. 2–4) is attached to valve actuator 28 in cooperation with aperture 33 by crimping, press fitting or by means of a plastic rivet. In its middle region, valve actuator 28 defines an opening 37, which allows flint 24 to extend from lighter body 12 through valve actuator 28 to reach rotary sparker 20.

Valve 40 controls the release of fuel from reservoir 42. In a preferred embodiment, valve 40 is a normally open valve, forced open by the pressure of fuel within reservoir 42. In this embodiment, as shown in FIG. 2, valve actuator 28 acts on valve 40 to maintain it in a closed position. Compression spring 44 pushes up on a first end of valve actuator 28, forcing the second, opposite end to act downwardly on valve 40 where it extends through slot 32. This pressure maintains the valve in a closed position until thumb pad 36 is sufficiently depressed allowing the nozzle 43 of valve 40 to be lifted and thereby releasing the fuel. Second compression spring 46 acts between the valve actuator and valve stem to prevent release of fuel before the thumb pad is depressed to a sufficiently actuated position. It is contemplated that other suitable valve configurations may be selected by persons of ordinary skill in the art. For example, a normally closed valve, which is forced open by the lifting of the second end of the valve actuator due to depression of the thumb pad may be utilized.

Lighter 10 also has windbreaking shield 50 mounted on top of body 12 enclosing the spark-wheel supports 15 and around valve 40, as shown in FIG. 2. Shield 50 assists in the generation and maintenance of the flame. Referring to FIGS. 2 and 4, shield 50 comprises body portion 52 and cover portion 54 defining flame aperture 56.

As illustrated in FIGS. 2,3, and 4, an arcuate guard 60 is shaped and dimensioned to fit over the rotary sparker 20, and to be positioned radially beyond and above the turning wheels 18. However, the width of guard 60 is such that it extends between but preferably not over wheels 18. Guard 60 is preferably elevated above the surfaces of the turning wheels 18, such that guard 60 should be depressed before turning wheels 18 can be rotated. Guard 60 comprises at least one retaining member 61, an arcuate body portion 62 and an end member 63. End member 63 is received in body cavity 64, which is disposed adjacent to the wall of flint cavity 22 (for clarity in FIG. 2 body cavity 64 and end 63 are not shown to scale with respect to each other). Body cavity 64 can be positioned either above or below valve actuator 28. If body cavity 64 is positioned below the valve actuator, end member 63 is inserted through opening 37 defined on valve actuator 28 to be inserted in body cavity 64. To further resist the removal of guard 60, at least one lance member 66 is provided proximate to end member 63 and is oriented generally in an upward direction. Preferably two lance members are provided, and the tips of lance members 66 are positioned immediately adjacent to the wall of flint cavity 22 to assist in alignment and resist upward movement of guard 60.

Retaining member 61 cooperates with cover portion 54 of windbreaking shield 50 to retain guard 60 to the lighter. Preferably, retaining member 61 has an upturning hook and is tucked under cover portion 54 of shield 50 as shown in FIGS. 2 and 4.

Figure 12A:
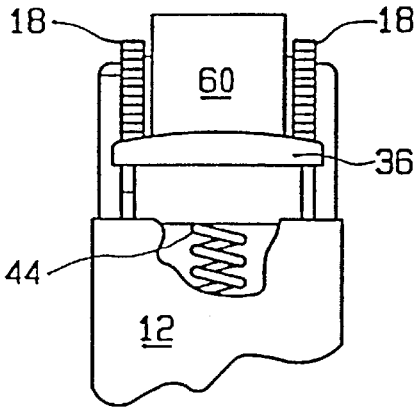
FIGS. 12(A–D) show the operation of a lighter with a guard disposed thereon.
Figure 12B:
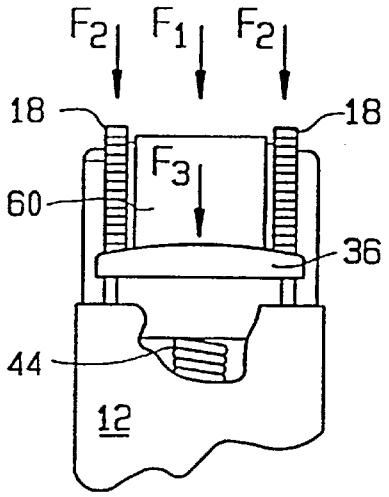
Figure 12C:
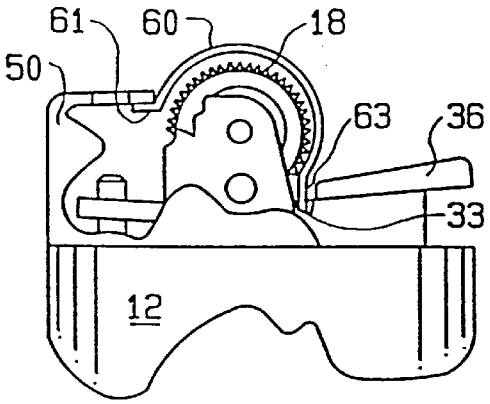
Figure 12D:
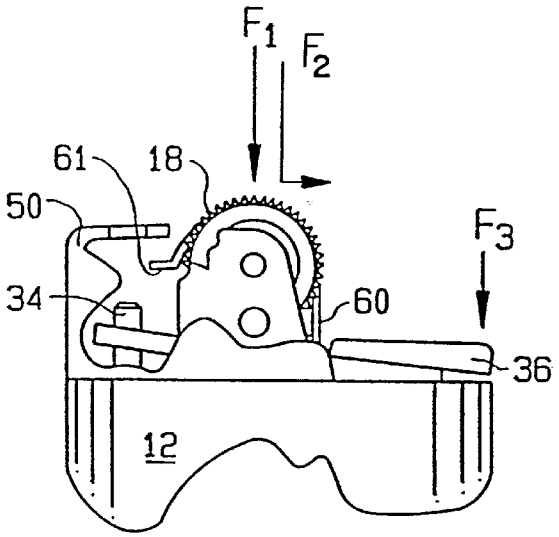

To operate the lighter the user asserts a sufficient pressure greater than a predetermined pressure necessary to deform guard 60 generally downward, such that guard 60 at least partially moves to a position closer to the turning wheels 18, or to a position between the turning wheels 18, to permit the user's finger to engage the wheels for rotation, as shown generally in FIGS. 12(A)–(D). As shown in FIGS. 12(A) and (C), guard 60 is in its undepressed state. Referring to FIGS. 12(B) and (D), F1 is first applied to guard 60 to partially move it to a position where turning wheels 18 can be manipulated. F2 is then applied to rotate the turning wheels 18 to produce the spark. F3 is then applied to depress thumb pad 36 of valve actuator 28 to actuate valve 40 to release the fuel to be ignited by the produced spark.

Alternatively, it is not necessary to deform guard 60. If guard 60 is positioned such that the fleshy, pulp portion of the adult user's finger is sufficient to extend over and around guard portion 60, the adult's finger can contact turning wheels 18 for rotation without such deformation. Preferably, rotation of the turning wheels would be a result of a combination of both types of action, i.e., the deformation of the guard and neck and the extension of the adult finger partially around the guard. It has been found that a guard made of stainless steel hardened to a hardness approximate to a Rockwell C-35 hardness, with a thickness of about 0.016 inch (0.4 mm), provides satisfactory results. As will be appreciated by persons of ordinary skill in the art, other materials, hardnesses and thicknesses may be used. Based on the teachings of the present invention as set forth herein, a person of ordinary skill in the art could adapt the present invention as desired.

Rotation of the turning wheels 18 causes a spark to be produced in a conventional manner. After the spark is produced by rotation of the turning wheels 18, the user's finger depresses the thumb pad 36 on the valve actuator 28 to actuate a release of fuel from the valve 40. This action occurs after the creation of the spark, as shown in FIG. 12(A)–(D). When rotated with sufficient force by an adult user, the spark created is large enough to ignite the fuel even though it is normally not released until a period of time after the creation of the spark.

The lighter as described above increases the difficulty of operation by children under five years of age, who do not have sufficient coordination, digit size or strength to operate the present invention as described.

In order to resist two-hand operation of the lighter, at least one blocking member 70 is provided on valve actuator 28. Preferably, two blocking members are disposed between slot 32 and tabs 30, as shown in FIGS. 5–8. Each blocking member 70 is angled generally upward and has clearance surface 72 disposed at the top of the blocking member. Blocking members 70 are configured and dimensioned to physically engage retaining member 61 of guard 60 once valve actuator 28 is depressed as shown by comparing FIG. 2 to FIG. 9. Thus, if a user attempts to actuate the lighter by first depressing the valve actuator 28 with one hand and then rotating the turning wheels 18 with another, blocking members 70 engage retaining member 61 and inhibit downward movement of guard 60 to resist the rotation of striking wheel assembly 14 to produce sparks.

It is also preferred that when the user first depresses guard 60 before depressing thumb pad 36 that retaining member 61 does not engage blocking members 70. For this purpose, clearance surface 72 is provided on blocking members 70 to provide clearance for the downward movement of retaining member 61 so that the downward movement of guard 60 is unimpeded.

Figure 10:
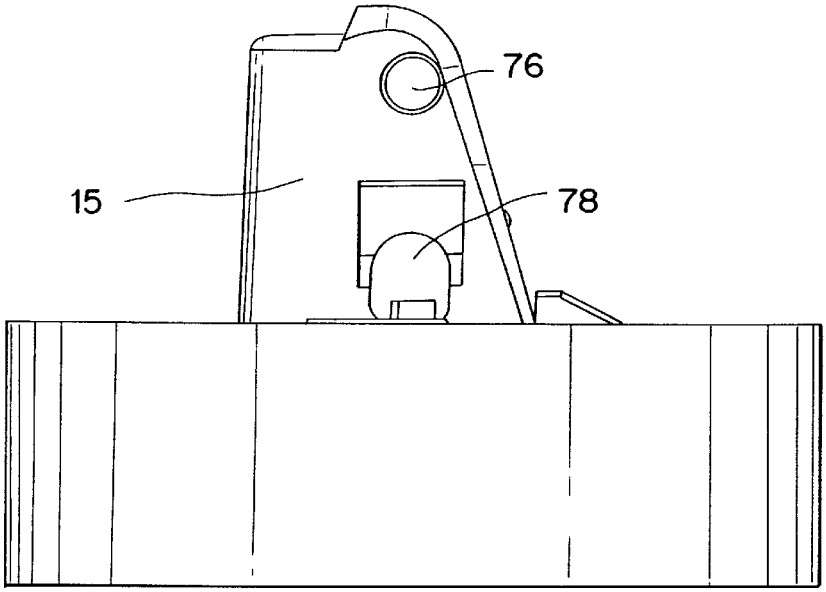
FIG. 10 is a front view of the spark wheel support showing the floating tab aperture in accordance with a second embodiment of the invention.
Figure 11:
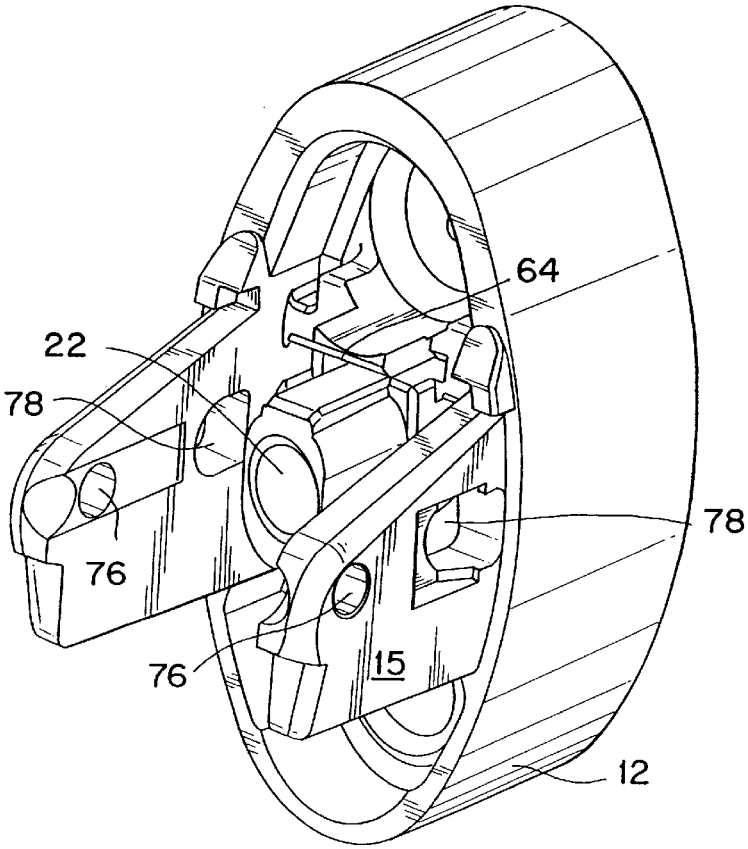
FIG. 11 is a perspective view of the spark wheel supports shown in FIG. 10 showing the floating tab apertures.

To assist the manufacturing process of lighter 10, the present invention provides floating tab apertures 78, as shown in FIGS. 10 and 11. Tab apertures 78 have generally an oval shape with a minor axis and a major axis, and are dimensioned to be larger than tabs 30 of valve actuator 28, such that tabs 30 are generally movable within floating tab apertures 78. The shape of floating tab apertures 78 controls the movement of valve actuator 28. For example, as shown in FIGS. 10 and 11, apertures 78 are orientating in a vertical direction. In other words, the major axis of aperture 78 is parallel to a longitudinal axis of the lighter body 12. Thus, valve actuator 28 is movable in the vertical direction. Spring 44 tends to push valve actuator 28 upward and therefore tabs 30 are normally positioned at the top of the floating tab apertures.

During the manufacturing process, after valve actuator 28, spring 44 and valve 40 are installed on lighter body 12, valve actuator 28 can be resiliently moved downward against spring 44 to create more room for the assembly of spark wheel assembly 14 and guard 60. It is preferred that floating tab apertures 78 are provided on lighter body 12 when valve actuator 28 is equipped with blocking members 70, because the configuration and dimension of the blocking members along with the close proximity of the blocking members to the spark wheel assembly 14 and guard 60 can interfere with the assembly of the spark wheel assembly 14, guard 60 and shield 50.

While various descriptions of the present invention were described above, it is within the knowledge of one of ordinary skill in the art to use the various features of the present invention singly or in any combination thereof. Therefore, this invention is not to be limited to only the specifically preferred embodiments depicted therein.

What is claimed is:

1. A lighter comprising:

a lighter body containing a fuel reservoir in communication with a valve for releasing fuel therefrom;

spark producing element rotatable by a user to produce sparks directed toward said valve, said element mounted on the body with at least a portion thereof exposed for manipulation and rotation by the user;

a guard member mounted on the lighter and extending around at least said exposed portion of said spark producing element, wherein said guard member is disposed radially outward from said spark producing element and is depressible to a position permitting manipulation of said spark producing element;

a valve actuator depressible to actuate said valve and release said fuel, and a blocking member cooperating with said valve actuator to resist the depression of said guard member after said valve actuator is depressed.

2. The lighter as set forth in claim 1, wherein the guard member comprises a first end, wherein the first end is received in a cavity in the lighter body.

3. The lighter as set forth in claim 2, wherein the guard member further comprises at least one lance disposed proximate to said first end, said lance cooperates with a portion of the lighter body to resist relative movement between said first end and the lighter body.

4. The lighter according to claim 1, wherein: said valve actuator comprises a lever pivotable about a point proximate to said spark producing element with a first end depressible by a user and a second end raisable in response thereto to actuate said valve; and said blocking member comprises at least one upstanding member disposed on said pivotable lever between said second end and the pivot point such that depression of the first end causes the blocking member to move to a location capable of restricting the depression the guard member.

5. The lighter according to claim 4, wherein said upstanding member of said blocking member has a clearance surface defined thereon such that before the valve actuator is depressed said guard member is depressible to said position permitting manipulation.

6. The lighter according to claim 1, wherein said valve actuator comprises a pivoting lever having tabs disposed thereon and said tabs are received in apertures defined on the lighter body, such that said valve actuator is pivotally supported within said apertures and is movable within said apertures.

7. The lighter according to claim 1, wherein: said valve actuator comprises a lever pivotable about a point proximate to said spark producing element with a first end depressible by a user and a second end raisable in response thereto to actuate said valve; and said blocking member comprises at least one upstanding member disposed on said pivotable lever between said second end and the pivot point such that depression of the first end causes the blocking member to engage the guard member.

8. A lighter comprising:

a lighter body containing a fuel reservoir in communication with a valve for releasing fuel therefrom;

spark producing element rotatable by a user to produce sparks toward said valve, said element mounted on the body with at least a portion thereof exposed for manipulation and rotation by the user; and a valve actuator depressible to actuate said valve, said valve actuator comprises tabs adapted to be received within corresponding tab apertures defined on said lighter body such that said valve actuator is pivotally and movably supported by said tab apertures, wherein said tab apertures have generally an oval shape having a minor axis and a major axis wherein said major axis is parallel to a longitudinal direction of said lighter body.

9. A lighter comprising:

a lighter body containing a fuel reservoir in communication with a valve for releasing fuel therefrom;

spark producing element rotatable by a user to produce sparks toward said valve, said element mounted on the body with at least a portion thereof exposed for manipulation and rotation by the user;

a valve actuator depressible to actuate said valve, said valve actuator comprises tabs adapted to be received within corresponding tab apertures defined on said lighter body such that said valve actuator is pivotally and movably supported by said tab apertures; and a guard member mounted on the lighter and extending around at least said exposed portion of said spark producing element, wherein said guard member is disposed radially outward from said spark producing element and is depressible to a position permitting manipulation of said spark producing element, and a blocking member cooperating with said valve actuator wherein said blocking member engages said guard member to resist depression of said guard member after said valve actuator is depressed.

* * * * *